US011072517B2

(12) United States Patent
Kundel, Sr.

(10) Patent No.: US 11,072,517 B2
(45) Date of Patent: Jul. 27, 2021

(54) JIB CRANE WITH TENSION FRAME AND COMPRESSION SUPPORT

(71) Applicant: Kundel Industries, Inc., Vienna, OH (US)

(72) Inventor: Robert L. Kundel, Sr., Cortland, OH (US)

(73) Assignee: Kundel Industries, Inc., Vienna, OH (US)

( * ) Notice: Subject to any disclaimer, the term of this patent is extended or adjusted under 35 U.S.C. 154(b) by 237 days.

(21) Appl. No.: 16/381,338

(22) Filed: Apr. 11, 2019

(65) Prior Publication Data

US 2020/0325006 A1 Oct. 15, 2020

(51) Int. Cl.

| | |
|---|---|
| ***B66C 23/16*** | (2006.01) |
| ***B66C 23/02*** | (2006.01) |
| ***B66C 23/66*** | (2006.01) |
| ***B66C 23/70*** | (2006.01) |

(52) U.S. Cl.

CPC ..... *B66C 23/66* (2013.01); *B66C 23/022* (2013.01); *B66C 23/025* (2013.01); *B66C 23/16* (2013.01); *B66C 23/70* (2013.01)

(58) Field of Classification Search

CPC ..... B66C 23/022; B66C 23/025; B66C 23/16; B66C 23/66; B66C 23/70

See application file for complete search history.

(56) References Cited

U.S. PATENT DOCUMENTS 2,825,471 A * 3/1958 Bushman ..... B66C 23/022 212/253
3,221,771 A * 12/1965 Dollinger ..... B66C 13/18 137/615
3,942,554 A 3/1976 Werner et al.
3,942,650 A 3/1976 Peytavin
4,053,060 A 10/1977 Wilson
(Continued)

FOREIGN PATENT DOCUMENTS

WO WO-2019041997 * 3/2019 ..... B66C 23/68

OTHER PUBLICATIONS

Gorbel Inc., Introduction to Jib Cranes, 2012, USA, http://www.gorbel.com/authosizedusers.asp.
Various, Cranes, 2016.

*Primary Examiner* — Michael R Mansen
*Assistant Examiner* — Juan J Campos, Jr.
(74) *Attorney, Agent, or Firm* — Roth Blair Roberts Strasfeld & Lodge

(57) ABSTRACT

A jib crane assembly having a vertical pole and a boom for lifting a load. The pole has a length and cylindrical outer surface. A pivot structure is arranged at an upper segment of the pole such that the boom is rotatably secured at a pivot point, thereby dividing the boom into first and second portions. A compression support extends from the first portion of the boom to a compression roller engagement assembly, and a tension roller engagement assembly is secured to the second portion of the boom, opposite the compression roller assembly. The tension roller assembly is attached to a tension frame, wherein said compression support, compression roller assembly, tension frame, and second portion of the boom provide structural support and counter-balance when lifting the load, and the pivot structure and roller assemblies facilitate rotation of the load around the pole.

10 Claims, 14 Drawing Sheets

(56) References Cited

U.S. PATENT DOCUMENTS

| | | | | |
|---|---|---|---|---|
| 4,061,230 | A * | 12/1977 | Goss | B66C 23/38 212/179 |
| 4,076,128 | A | 2/1978 | Tax | |
| 4,271,970 | A | 6/1981 | Miller et al. | |
| 4,317,524 | A | 3/1982 | Andersson | |
| 4,446,975 | A | 5/1984 | Konig | |
| 4,449,635 | A | 5/1984 | Helm et al. | |
| 4,483,448 | A | 11/1984 | Wittman et al. | |
| 4,489,818 | A | 12/1984 | Franke et al. | |
| 4,625,671 | A | 12/1986 | Nishimura | |
| 4,645,084 | A | 2/1987 | Deike | |
| 4,711,604 | A | 12/1987 | Heimsoth et al. | |
| 5,261,542 | A | 11/1993 | Robbie | |
| 5,325,844 | A | 7/1994 | Rogers et al. | |
| 5,645,180 | A | 7/1997 | Zaguroli, Jr. | |
| 6,039,194 | A | 3/2000 | Beeche et al. | |
| 6,286,695 | B1 | 9/2001 | Tetreault | |
| 6,354,782 | B1 | 3/2002 | Barry | |
| 6,517,131 | B1 | 2/2003 | Haataja | |
| 6,631,815 | B1 | 10/2003 | Laenge | |
| 7,627,393 | B2 | 12/2009 | Sawodny et al. | |
| 8,578,208 | B2 | 11/2013 | Gyllenskog et al. | |
| 8,708,170 | B2 | 4/2014 | Schneider et al. | |
| 8,844,738 | B2 | 9/2014 | Thompson | |
| 9,127,434 | B2 | 9/2015 | Shiratani et al. | |
| 9,457,874 | B2 | 10/2016 | Jacobsen et al. | |
| 9,510,522 | B2 | 12/2016 | Yrjana et al. | |
| 9,688,516 | B2 | 6/2017 | Billot et al. | |
| 2002/0060199 | A1 | 5/2002 | Sundberg et al. | |
| 2002/0066710 | A1 | 6/2002 | Spitsbergen | |
| 2002/0150453 | A1 | 10/2002 | Hedley et al. | |
| 2004/0040925 | A1 | 3/2004 | Miller | |
| 2008/0245522 | A1 * | 10/2008 | Hamilton | B66C 23/16 166/77.51 |
| 2013/0037768 | A1 | 2/2013 | Hayes | |
| 2013/0058747 | A1 | 3/2013 | Kimura et al. | |
| 2013/0079168 | A1 * | 3/2013 | Peters | A63G 9/14 472/118 |
| 2014/0133949 | A1 | 5/2014 | Nishimura | |
| 2014/0158656 | A1 | 6/2014 | Pembleton | |
| 2014/0294540 | A1 | 10/2014 | Shaw et al. | |
| 2015/0014266 | A1 | 1/2015 | Rafailovic et al. | |
| 2015/0123059 | A1 | 5/2015 | West et al. | |
| 2015/0125248 | A1 | 5/2015 | Sasaki | |
| 2017/0071807 | A1 | 3/2017 | Liljedahl | |
| 2017/0113905 | A1 * | 4/2017 | Schroeder | B66C 23/94 |
| 2017/0129752 | A1 | 5/2017 | Koster et al. | |
| 2018/0050622 | A1 | 2/2018 | Roberts et al. | |
| 2018/0319008 | A1 | 11/2018 | Cook | |

* cited by examiner

JIB CRANE WITH TENSION FRAME AND COMPRESSION SUPPORT

FIELD OF THE INVENTION

The present invention is generally directed to the field of jib cranes. In particular, the present invention is directed to a crane having both tension and compression supports, arranged for rotation of a crane boom about a support pole or post.

BACKGROUND

Cranes, hoists and other various lifting arrangements are found in a wide variety of sizes and configurations. A key determinant in the size and configuration of a crane or other lifting device is the size and configuration of the load to be handled. Within the constraints dictated by load size, the overall environment in which the crane is placed will also be an important determinant in selecting the crane configuration and its support arrangements.

Since cranes, especially those used in building construction, are generally temporary structures, applied to carry out a specific job, the mobility and ease of assembly of the crane system is an important factor in the selection and application of the particular crane. Likewise, ease of operation is critical, especially if time constraints are determined by the environment or the job to be done.

Accordingly, there is always a need for efficient crane installation and easy operation.

SUMMARY OF THE INVENTION

It is a primary object of the present invention to provide a crane system that is strong, stable, easy to install, and flexible in operate. The crane system must be compact, with a small yet sturdy support footprint.

It is another object of the present invention to provide a crane system with a jib boom that is easy to rotate in a 360° arc, with or without a load.

It is a further object of the present invention to provide a crane system that is easily mounted in a wide variety of different environments, including concrete pads and steel platforms.

It is again another object of the present invention to provide a substrate interface-support particularly configured for a crane system having a cylindrical vertical pole.

It is an additional object of the present invention to provide a crane system with a simple compact internal support arrangement, having the advantages of both a compression type boom support and a tension type boom support.

It is still another object of the present invention to provide a jib crane configuration that can be easily scaled for accommodating different load ranges and environments.

It is again an additional object of the present invention to provide a crane system which requires minimal support from the environment in which the crane is placed.

It is still another object of the present invention to provide a crane system having a boom which is freely rotatable, without sacrificing strength and stability when under load.

It is yet a further object of the present invention to provide a crane system in which smoothness of boom rotation is facilitated by easy leveling of the crane's vertical support with respect to the foundational support and substrate.

It is still another object of the present invention to provide a crane system that accommodates and/or works with a wide variety of substrate interface-supports.

It is again a further object of the present invention to provide a crane system that uses the counter-balance between compression and tension to improve lifting strength and durability over conventional cranes.

It is yet a further object of the present invention to provide a crane system with a rotating boom arranged in a manner so that destructive lateral stresses, including shear forces and bending moments, are transferred from the pivot point at the rotating boom and vertical pole, to the pole length.

It is still an additional object of the present invention to provide a crane system that minimizes environmental constraints on the assembly and operation of the crane.

These and other goals and objects of the present invention are achieved by an interconnected boom support system having a cylindrical post or pole for lifting, carrying, and setting down a load. The pole has an outer surface and a length with an upper segment. A pivot structure is preferably arranged at the upper segment of the pole to accommodate a boom for lifting a load. The boom is rotatably secured to the pivot structure at a pivot point along the length of the boom, thereby dividing the boom into first and second portions. A compression support extends from the underside of the first portion of the boom to a compression roller engagement assembly positioned for rotatable engagement at the outer surface of the cylindrical pole. A tension roller engagement assembly is secured to the second portion of the boom and is also positioned for rotatable engagement around the outer surface of the cylindrical pole, opposite the compression roller engagement assembly. A tension frame extends from the tension roller engagement assembly to the compression roller engagement assembly. As a result, the compression support, compression roller engagement assembly, tension frame and second portion of the boom is arranged to provide structural support and counterbalancing for lifting the load. The pivot structure at the upper segment of the cylindrical pole, the compression roller engagement assembly and the tension roller engagement assembly facilitate easy rotation of the load around the support pole.

BRIEF DESCRIPTION OF THE DRAWINGS

The drawings included herewith are for the purpose of illustration only and not as a definition of the limits of the instant invention, for which reference should be made to the claims appended hereto. Other features, objects and advantages of this invention will become clear from the following more detailed description made with reference to the drawings in which:

DETAILED DESCRIPTION OF THE PREFERRED EMBODIMENTS

Figure 1:
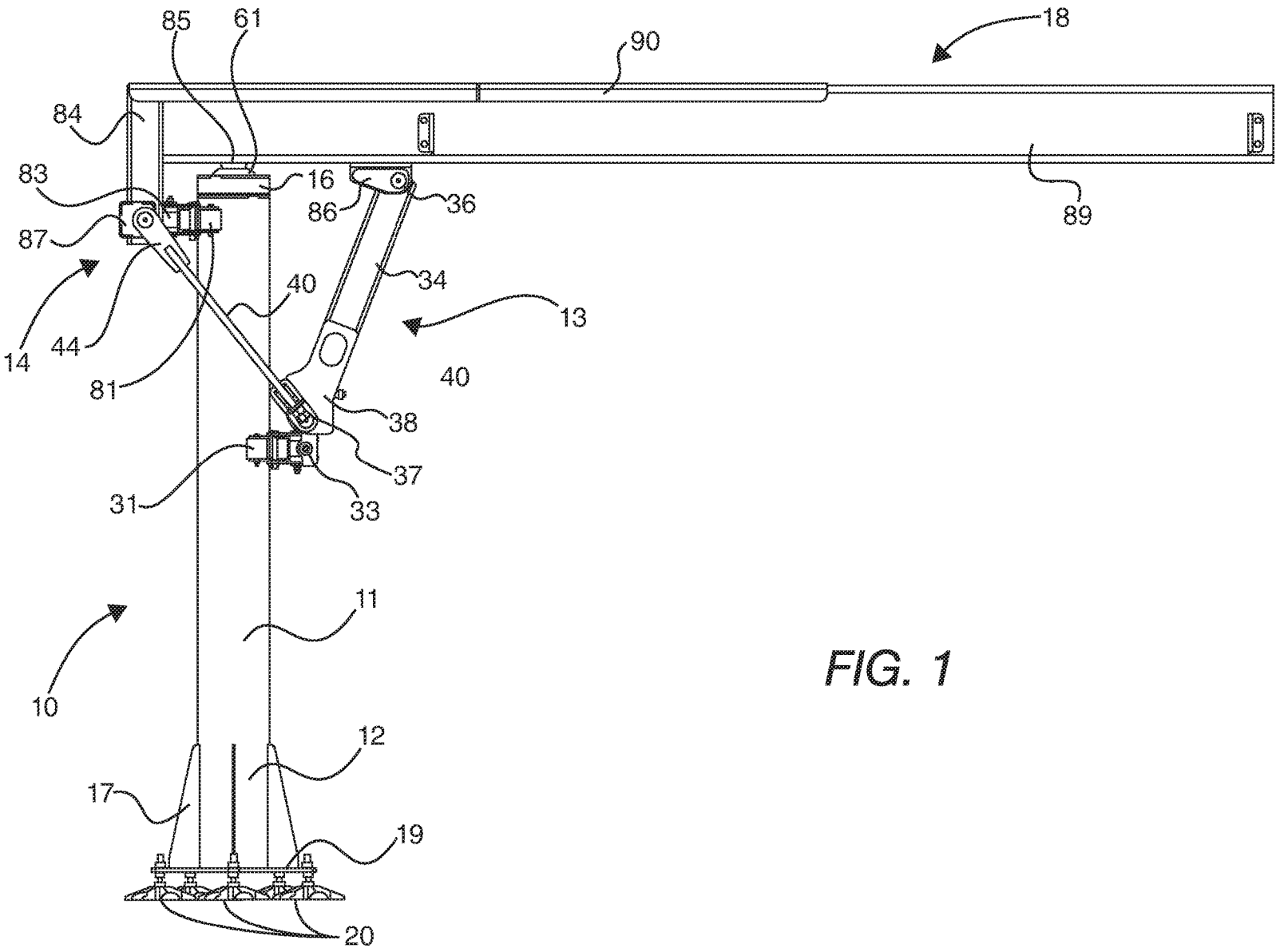
FIG. 1 is a side elevational view of the overall jib crane arrangement.

The following descriptions depict only example embodiments and are not to be considered limiting of its scope. Any reference herein to "the invention" is not intended to restrict or limit the invention to exact features of any one or more of the exemplary embodiments disclosed in the present specification. Reference to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Accordingly, the particular arrangements disclosed herein are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. When used to join a list of items, the term "or" denotes at least one of the items but does not exclude a plurality of items of the list.

In this case, the present disclosure is directed to a jib crane assembly 10. Jib crane assemblies of this type typically include vertical support provided by a post or pole 11, which is preferably constituted by a hollow steel cylinder. However, the vertical pole 11 can be made of other materials and/or can be a solid cross-sectional support. The pole 11 includes a lower base portion 12 with a substrate interface-support arrangement 20 having support fins 17 and a pole bearing plate 19 for providing support for the overall jib assembly 10 (via a necessary connection to the foundational substrate).

Figure 3:
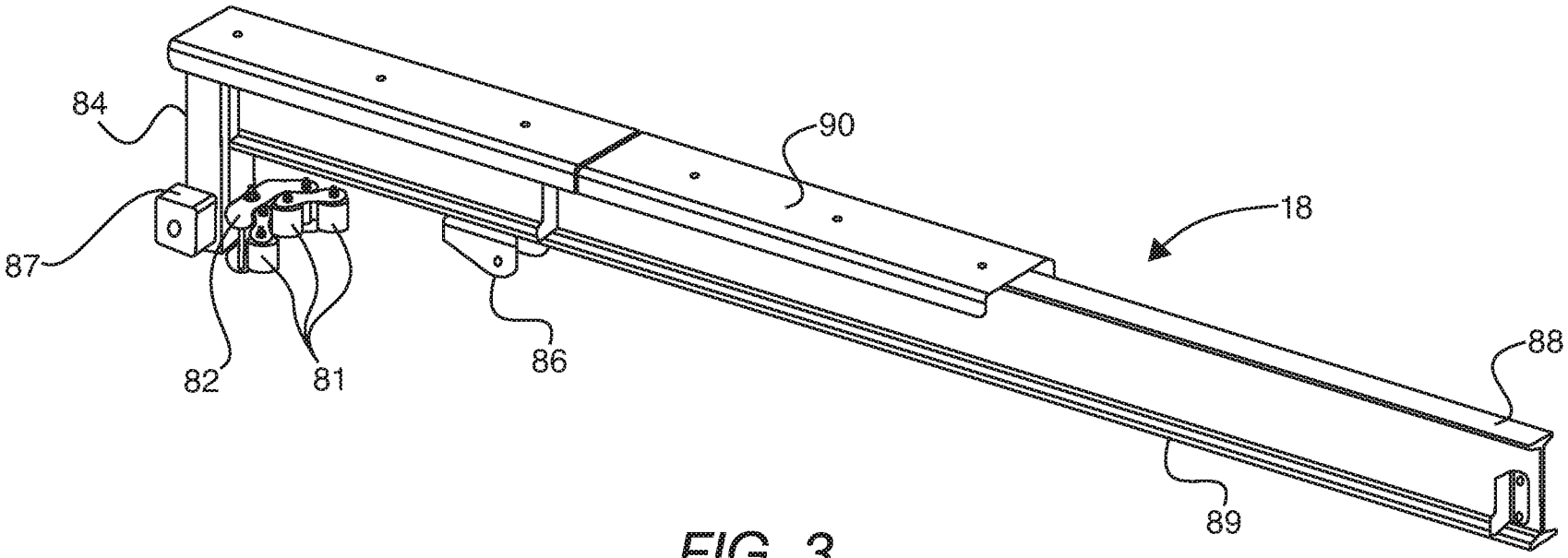
FIG. 3 is a top perspective view of a boom structure.
Figure 4:
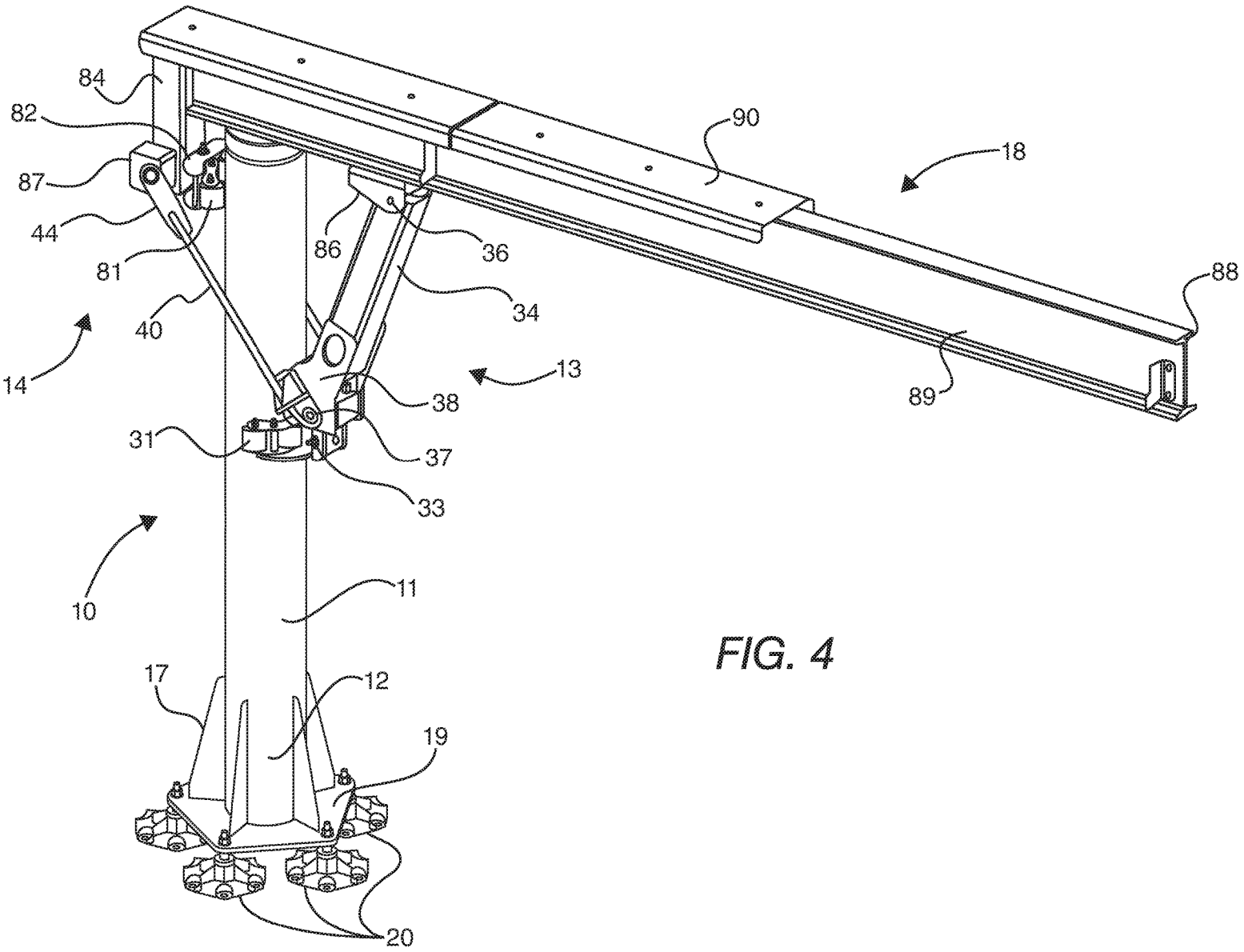
FIG. 4 is a top perspective view of the jib crane arrangement of FIG. 1.
Figure 5:
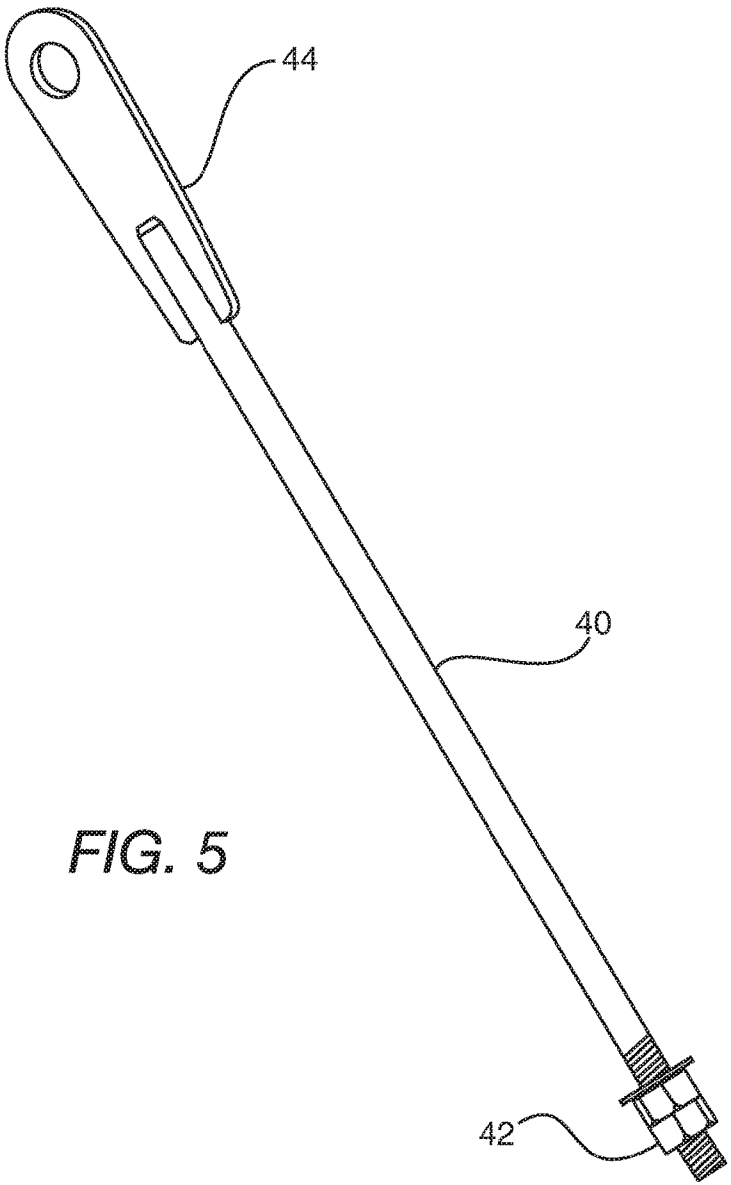
FIG. 5 is a side view of a tension arm.

A boom 18 of the jib crane assembly 10 is preferably an I-beam 89, with a top flange or plate 88, as seen in FIG. 3. However, any number of other appropriate structures can be used to constitute the boom 18 within the concept of the present invention. The I-beam configuration, depicted in the drawings, simply provides a particular robust boom structure and facilitates an easier connection to the various other structures that constitute the present invention.

The boom 18 engages the vertical pole 11 at pivot arrangement 16, which allows easy pivoting of the boom in a 360° arc. Easy rotation of boom 18 is facilitated by the essentially "free-floating" pivot arrangement 16 (depicted in FIGS. 11 and 12) that is held in place by the weight of boom 18. Free rotation of the pivot arrangement 16 is insured by the elimination of lateral stresses that would normally be caused by the uneven distribution of the boom 18 weight, and the handling of a load at the end of boom 18 when the jib crane assembly 10 is operated. The pivot arrangement 16 divides the length of the boom 18 into two sections. The first section includes the distal end of boom 18 used for lifting. The second section is the short part of boom 18 bounded by vertical connection 84.

Figure 6:
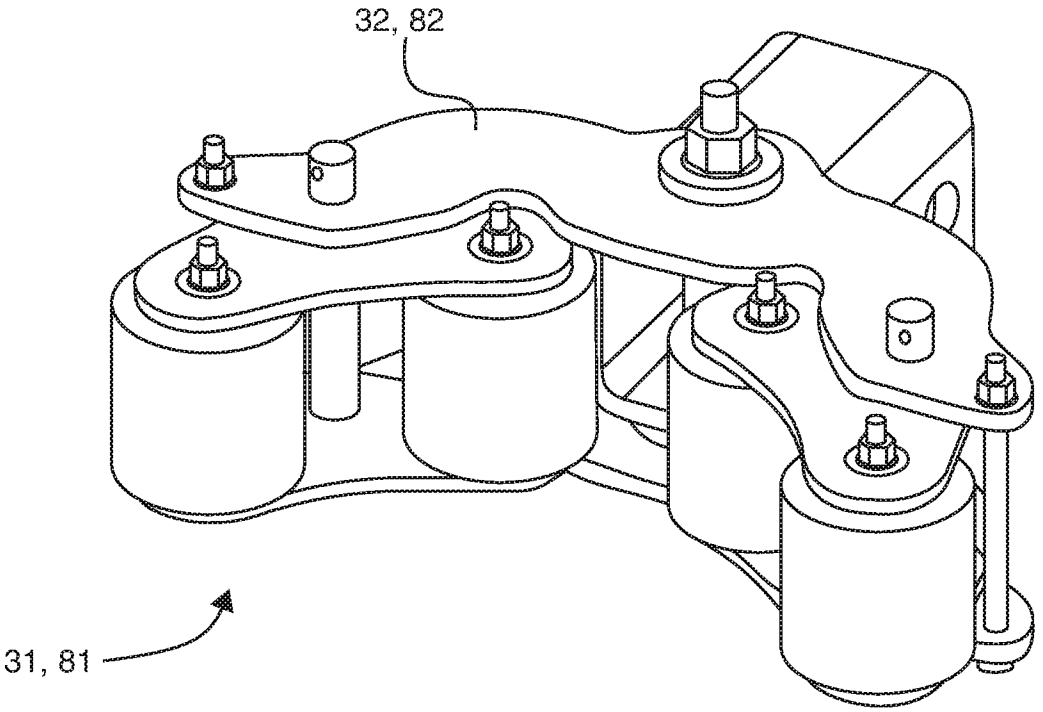
FIG. 6 is a perspective view of a roller engagement assembly for rotatable engagement with an outer surface of the vertical pole.
Figure 7:
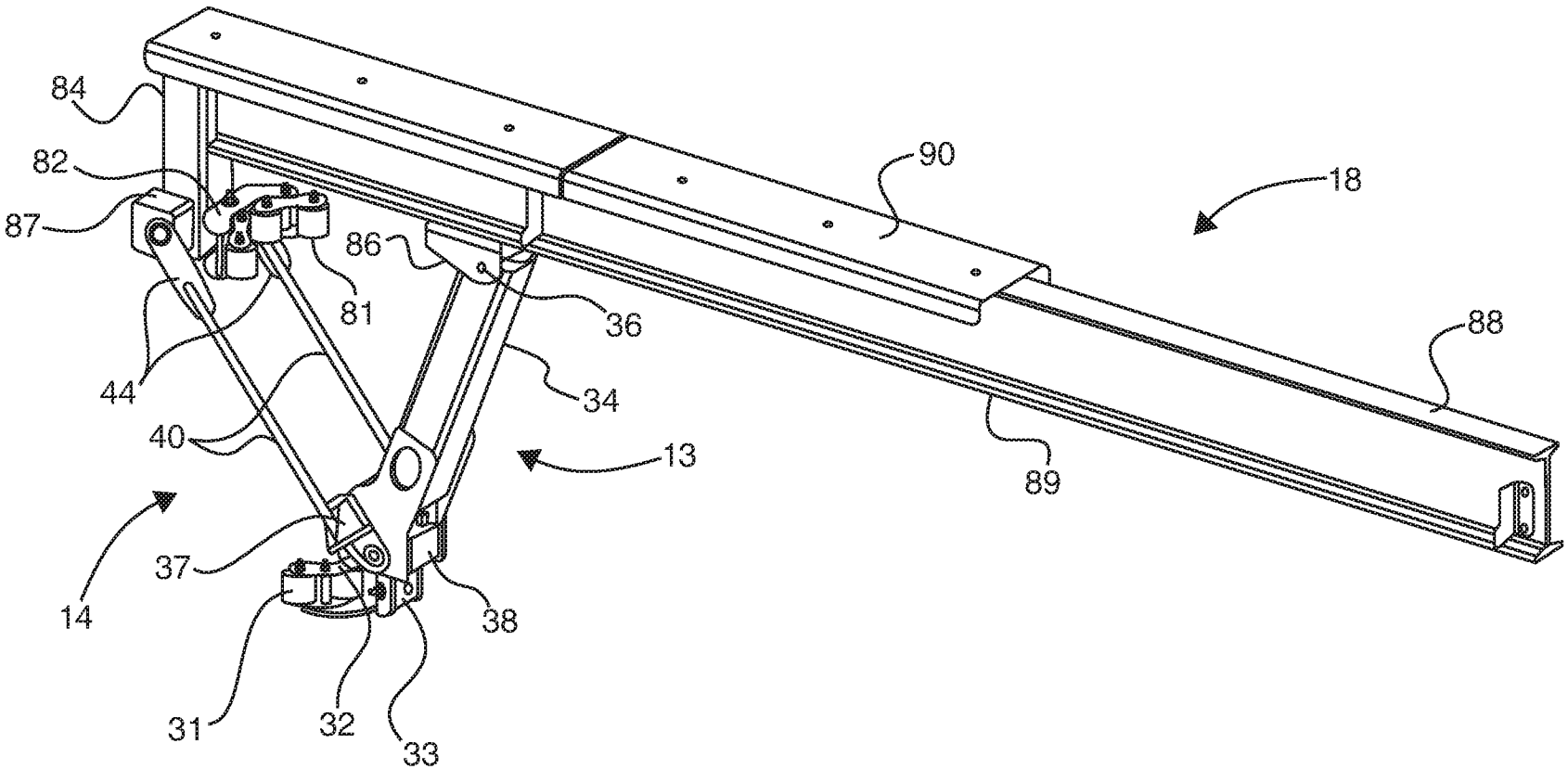
FIG. 7 is a perspective view of the boom assembly including the interconnection of a compression support and a tension frame.

The present invention combines two types of support used in a novel manner to counter-balance the load being lifted to opposite sides of the pole 11, away from the pivot arrangement 16. A compression assembly for boom 18 is provided by means of compression support 13 seen in FIG. 7. This structure is constituted by a tube or compression support member 34 fitted to the bottom flange or plate of the I-beam 89 by a bracket 86 and pivoting connection 36, in a conventional connection arrangement. The other end of compression support member 34 fits into receiving frame 38, which is connected to toggle 33 and compression roller yoke 32. The compression roller yoke 32 hold compression roller assembly 31, as seen in FIG. 6. It is the compression roller assembly 31 which interfaces with an outer cylindrical surface of the pole 11, provides lateral contact for rotational mobility of the boom 18, which is translated into horizonal support for the I-beam 89 mounted atop the pole at pivot arrangement 16.

The forces developed at the interface of compression roller assembly 31 and the surface of pole 11 are further distributed by tension arms 40, which extend from receiving frame 38 (to secure via attachment end-plate portions 44) to corresponding tension arm connection brackets 87. Brackets 87 flank and secure to vertical connector 84. Vertical connector 84 supports tension roller assembly 81 by means of a tension roller yoke 82, as seen in FIG. 6. Connector 84 is preferably welded to an end of beam 89, thereby forming part of boom 18, and adding weight, as well as structural support, to the second section of boom 18. Accordingly, the tension roller assembly 81 interfaces with the outer cylindrical surface of the pole 11 for lateral contact (opposite and preferably above the interface of the compression roller assembly 31), to further accommodate rotational mobility of the boom 18 (i.e., in combination with the compression roller assembly 31 about the pivot arrangement 16).

To be clear, the vertical connector 84 connects the tension roller assembly 81 (held by roller yoke 82) at the end of boom 18. As a result, the compression support 13, attached to the first section of the boom 18, is also supported in part by the end of the second section of boom 18, thereby helping to balance the load about the pivot arrangement 16. Accordingly, stresses are transmitted through tension arms 40 and transferred into lateral forces by the pressure of the tension roller assembly 81 against pole 11, beneath the pivot assembly 16. In addition to the distributing forces developed from compression support 13 and tension frame 14, vertical connector 84 serves to provide added weight to the end of the second section of the boom 18, thereby facilitating a counterbalance to the weight of the first section of the boom 19.

Also connected to vertical connector 84 is cover plate 90, which helps secure a connection between the beam 89 and vertical connector 84. Depending upon the exact configuration of beam 89, cover plate 90 can serve to stiffen the overall structure of boom 18. In addition, the cover plate 90 can serve to provide a covered platform for electrical lines, cables, pulleys and winching devices that are necessary when using the jib crane assembly 10 in its particular mechanical and functional configuration (e.g. manual versus electric hoist, with or without select hand controls, etc.). Though these features are not depicted in the drawings as part of the present invention, they are still essential to select hoist operational designs.

The second section (the shorter part of the boom 18 as divided by pivot assembly 16) provides support for tension roller assembly 81 (held by roller yoke 82 depicted in detail in FIG. 6). These in turn help support roller assembly 31 by way of tension arms 40. Moreover, the distribution of lateral forces through roller assemblies 31 and 81, to opposite sides of pole 11, permit free rotation of pivot assembly 16 by offsetting load forces through the tied structure. This is true even when heavy loads are applied to the distal end of first section of the boom 18. Because of the distribution and offsetting of lateral forces in the mutually supporting arrangement of beam 89, tension frame 14, and compression support 13, a relatively free moving pivot assembly 16 (such as that depicted in FIGS. 11 and 12) can be used. This facilitates easy operation when the present invention is used in lifting and transporting loads by rotating boom 18.

Figure 11:
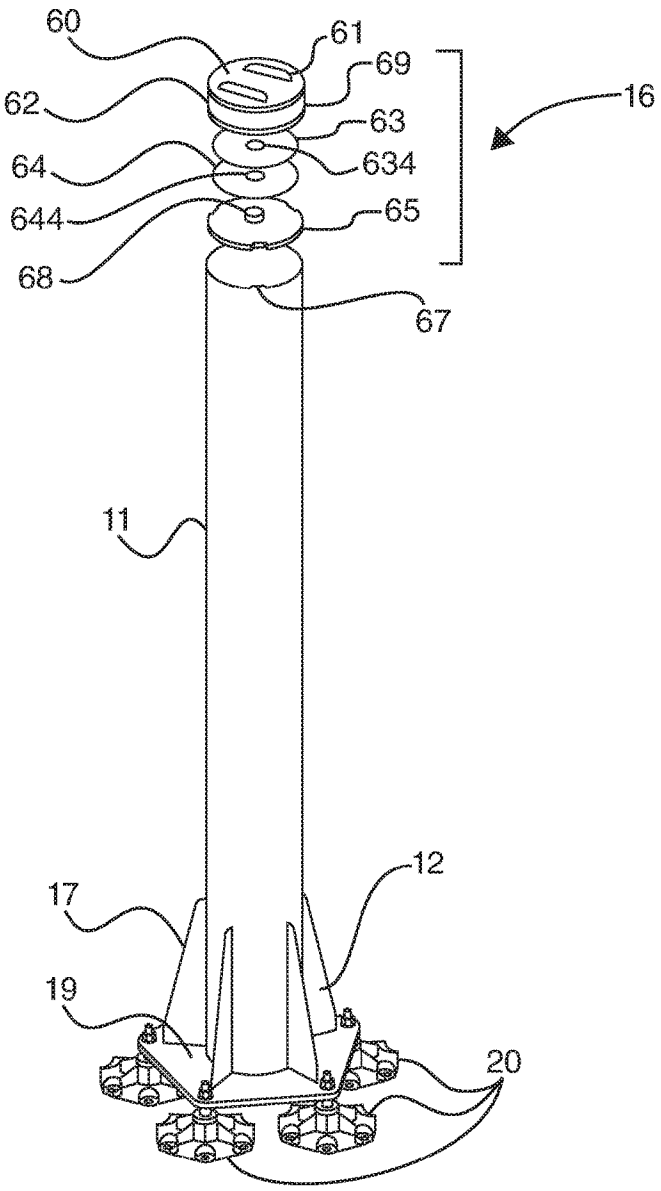
FIG. 11 is a perspective view of the pole, depicting the type of substrate interface-support structural arrangement shown in FIGS. 1 and 4, and including an exploded view of the pivot assembly mounted at a top of the upper segment of the pole.
Figure 12:
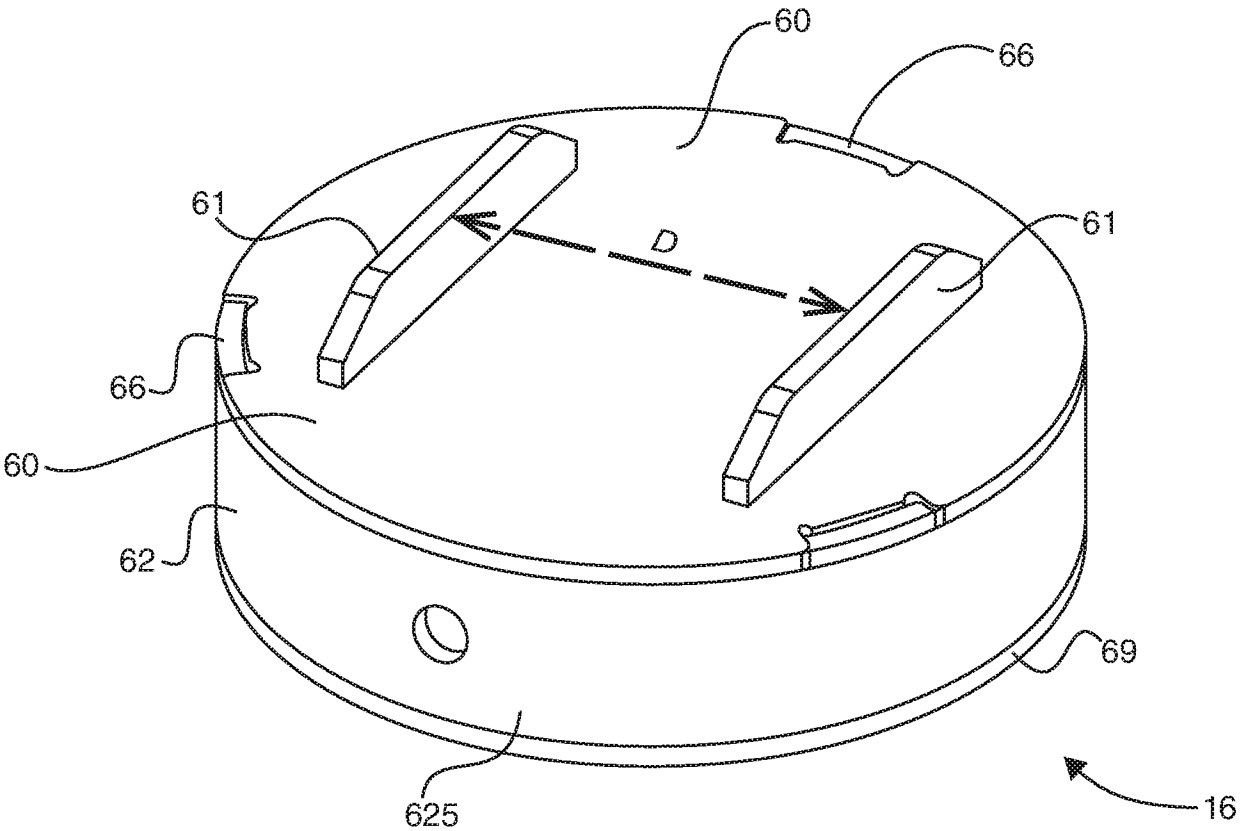
FIG. 12 is a perspective view of the pivot assembly.
Figure 13:
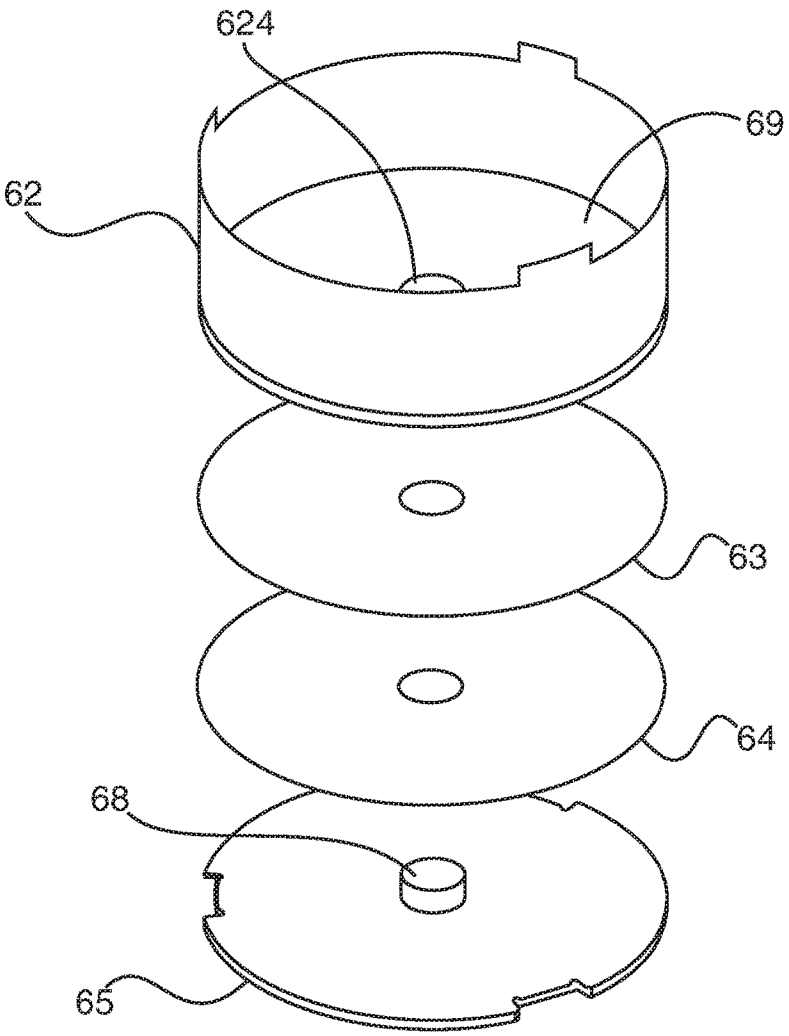
FIG. 13 is an expanded view of the pivot assembly shown in FIG. 12.

With reference to FIGS. 11, 12 and 13, the preferred embodiment of the pivoting assembly 16 includes a cap 60, cylindrical container 62, Teflon pads 63, 64, and end-plate 65. Cylindrical container or sleeve 62 includes an upper opening (which is covered by cap 60 in FIGS. 11, 12 and 13), sidewall 625 and a bottom plate 69. The cap 60 fits together with sleeve 62 using alignment tabs 66 in cylindrical sidewall 625 to lock the cap 60 from rotational movement with sleeve 62. Each of the bottom plate 69 and Teflon pads 63, 64 has a center hole or opening (624 in bottom plate 69 of sleeve 62; shown as 634 and 644 is Teflon pads 63, 64, respectively) for engaged alignment with the cylindrical alignment-tab or post 68 that extends from a top-face of end-plate 65, best seen in FIG. 11. The pole end-plate 65 has a thickness and includes notches along an outer perimeter for mating alignment and engagement with teeth 67 at the top end of the pole 11 to secure the end-plate 65 from rotation therewith. The cylindrical sleeve 62 is positioned on top of the end-plate 65, such that openings 625, 634, and 644 (in the bottom plate 69 of the sleeve 62 and the Teflon pads 63, 64, respectively) are in mating alignment with cylindrical post 68 of the end-plate 65. Accordingly, the Teflon pads 63, 64 are sandwiched between the end-plate 65 and bottom plate 69 of sleeve 62, thereby serving as mechanical lubricants for free rotation of the pivoting assembly 16.

Figure 14:
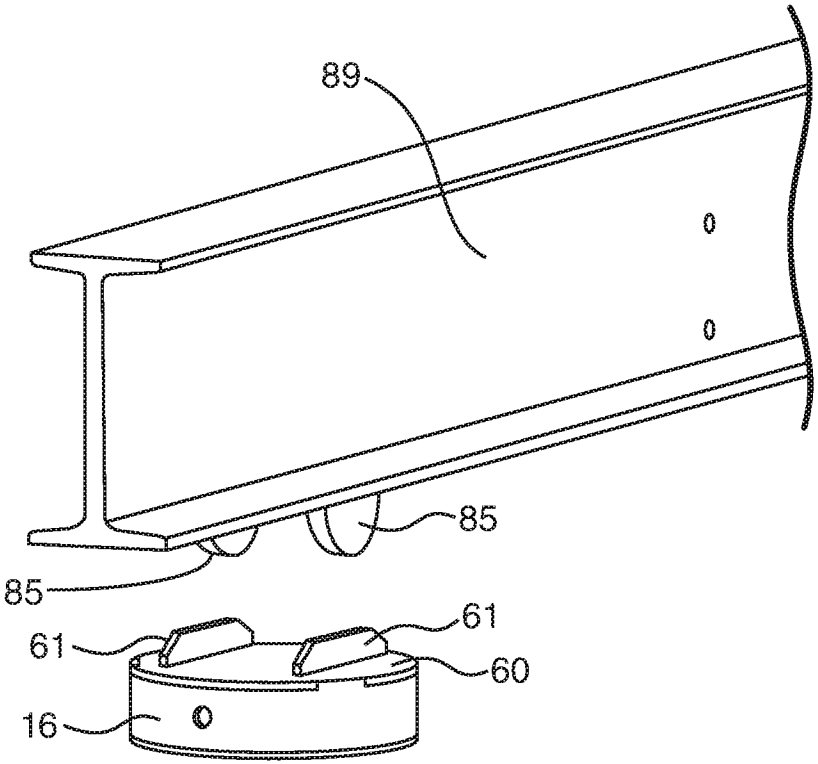
FIG. 14 is an isolated perspective view of the near end of the boom structure (without vertical piece 84) illustrating the pivot assembly configured to receive and confine a beam of the boom structure in rocking engagement therebetween.

Vertical alignment tabs 61 on the top side of cap 60 are used to confine therebetween a boom rocker-seat 85 welded to the bottom flange or plate of I-beam 89 to hold the I-beam 89 in place, preventing lateral movement during operation between vertical alignment tabs 61 at pivot assembly 16. The boom rocker-seat 85 can be a solid metal-piece having a semi-circular cross-section or arched curvature with a length slightly less than the space "D" between alignment tabs 61 for fitted positioning therebetween, as best seen with reference to FIGS. 12 and 14. As an alternative, the boom rocker-seat 85 can be constituted by at least two semi-circular or arched discs that are spaced (from outer-wall to outer-wall) to fit between space "D" of alignment tabs 61. The boom rocker-seat 85 allows for leveling of the boom 18 at pivot assembly 16 (i.e., horizonal adjustment) during set-up and while in use to accommodate slight flex-bending and/or some rotational movement of the boom length with lifting. The fit between vertical alignment tabs 61 and boom rocker-seats 85 should be slightly loose, so that horizontal rocking of the beam 89 is permitted within the seating provided by vertical alignment tabs 61.

As previously described, the freely rotating pivoting assembly 16 in the instant invention balances the boom 18 on top of pole 11 by dividing the boom 18 into first and second sections. The balancing at the pivoting assembly 16 is accomplished using the weight of vertical connector 84 in conjunction with the interconnecting configuration of the support structure, namely the compression support 13 and tension frame 14. The balance achieved thereby is determinative of the ease of rotation of the entire boom and interconnected support structure as a unit. It should be noted that the pivoting assembly 16 depicted in FIGS. 11-14 is only one example of a freely rotating pivot arrangement. Other types of pivoting assemblies can be used to facilitate the advantages gained by the present invention, including a slewing ring bearing.

It is noted that pivoting assembly 16 rests on top of pole 11 by the weight of boom 18. Lateral forces, otherwise at the pivoting assembly 16, have been transferred by the novel interconnected support structure constituted by the vertical connector 84, tension roller assembly 81, tension arms 40, compression roller assembly 31, and the rest of compression support 13, along with its connection to beam 89 is bracket 86. The result is a highly desirable ease of rotation of the boom 18 (along with all the supporting elements), even with a load at the distal end of I-beam 89.

Free rotation of the boom 18 of the jib crane assembly 10 about pole 11 is facilitated because the support system (compression support 13 and tension frame 14) is entirely self-contained, using only pole 11 to transfer stresses caused by forces at the end of beam 89. Since the subject support system does not have to rely upon external connections to the environment (as is very common with many tension support arrangements used to balance heavy boom loads), the overall footprint of the inventive jib crane assembly 10 is much reduced over that of many conventional lifting systems. Also, since there are no additional external connections are needed to help maintain boom support, 360° rotation of the boom is easily facilitated in smaller work spaces. Further yet, since the second (i.e., shorter) portion of the boom, more easily avoids rotation obstructions, use of the instant jib crane assembly 10 in a confined space is easily facilitated.

The simple design of the instant jib crane assembly 10 allows easy scaling to fit various environments and duty cycles. Accordingly, the compact support arrangement of the inventive jib crane assembly 10 can require mounting in a relatively small area, thereby requiring a novel substrate anchoring support-interface arrangement 20. To be clear, the instant invention creates a need for an innovative anchoring system for mounting the pole 11 to a surface such as new concrete or an existing foundation having varied strengths and depths.

Figure 2:
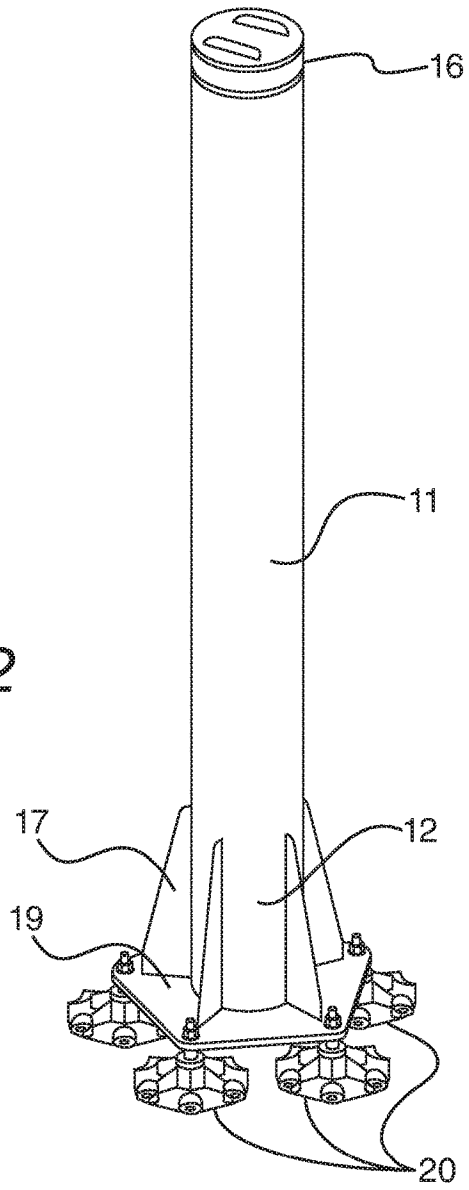
FIG. 2 is a perspective view of the vertical pole, including a substrate interface-support arrangement.
Figure 8:
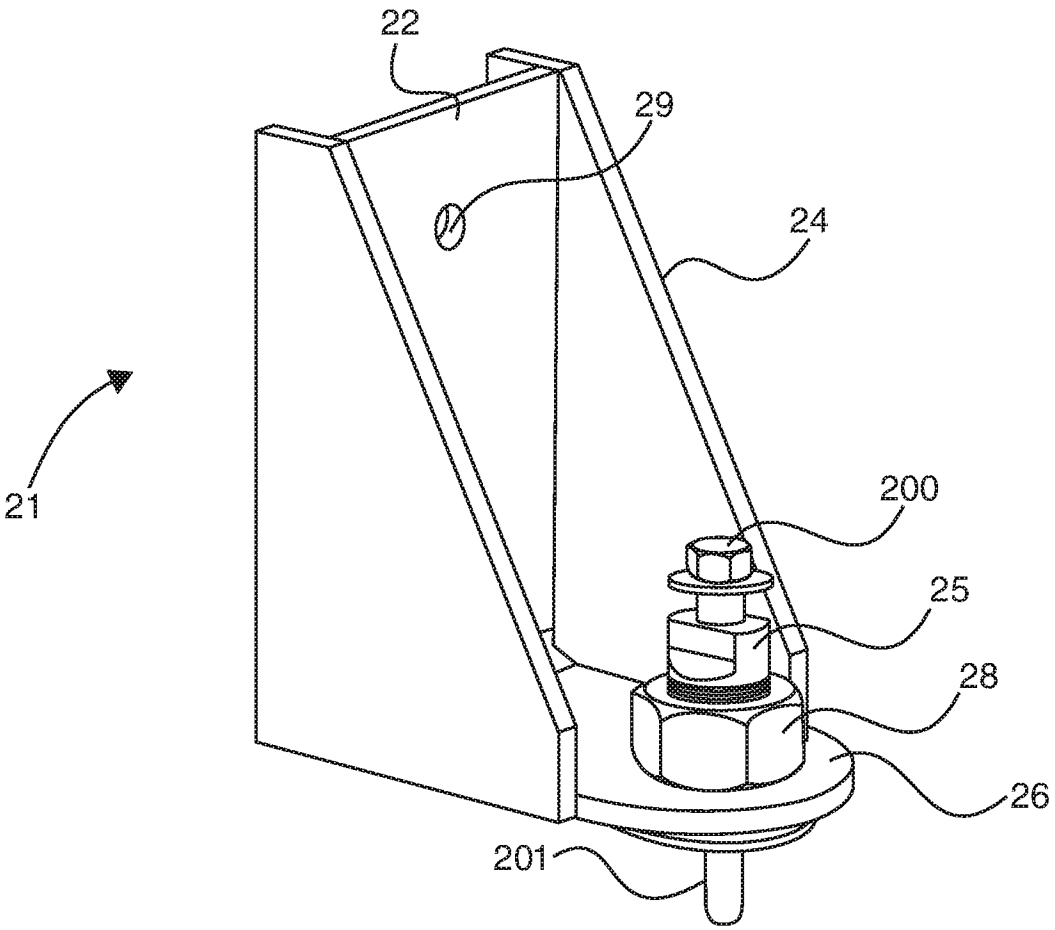
FIG. 8 is an alternative support bracket (different than that shown in FIGS. 1 and 4) used as part of the substrate interface-support structural arrangement at a lower base portion of the vertical pole of the jib crane arrangement and being adjustable for truing the pole.
Figure 9:
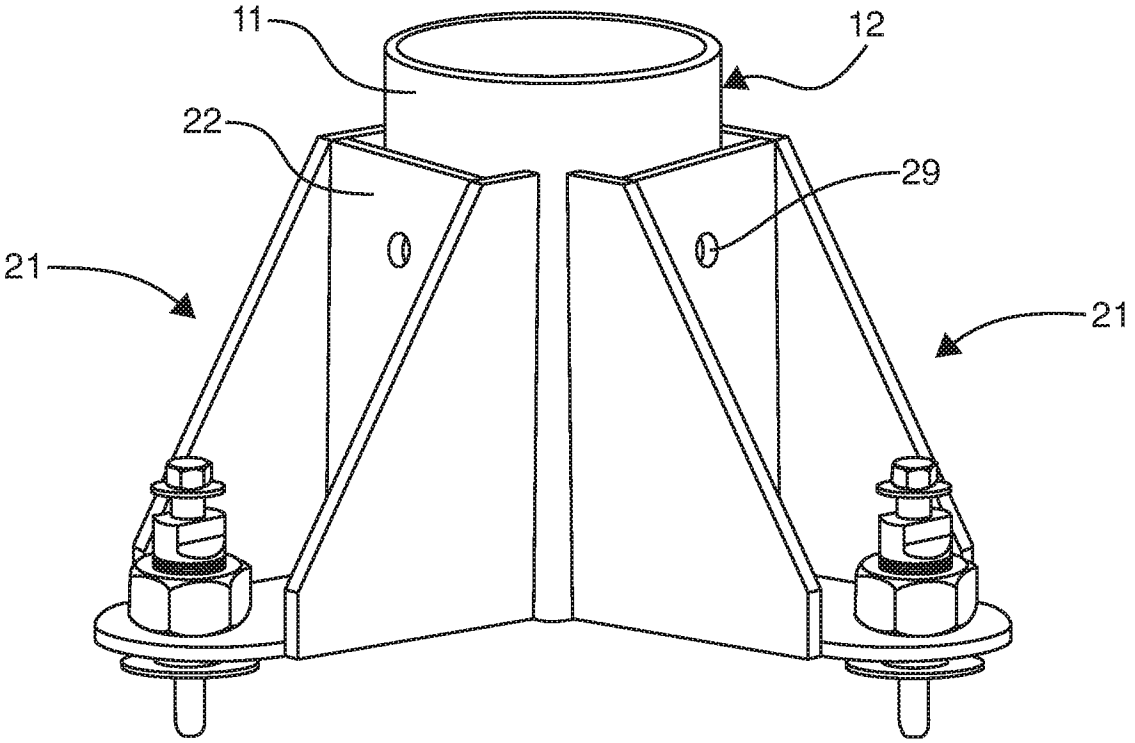
FIG. 9 is a perspective view depicting multiple brackets of those shown in FIG. 8 arranged around the lower base portion of the vertical pole, for supporting the pole of the crane arrangement to a foundational substrate.

FIG. 2 depicts a conventional substrate interface-support arrangement 20. This is better described in U.S. Pat. No. 9,518,402, assigned to the same owner as the present application. However, two different variations of an inventive embodiment are depicted in the drawings at FIGS. 8, 9 and 10. More specifically, FIG. 8 depicts a pole support bracket 21, which is designed to be mounted to the lower base portion of the pole 11 by means of connectors passing through openings 29 of pole engagement plate 22. In use, multiple support brackets 21 depicted in FIG. 9, are secured around the lower base portion 12 of the pole 11. While only two pole brackets 21 are seen in FIG. 9, any number of pole brackets can be used, depending upon the diameter of the pole and the nature of the substrate. In some instances, for example, five or more brackets may be required. Preferably, the pole support bracket 21 is used in the manner shown in the FIG. 9, depicting a plurality of pole support brackets around the entire circumference of the pole 11. However, it should be noted that depending upon the strength of the foundational substrate any number and arrangement of pole support brackets 21 can be used, to accommodate particular environments and for particular duty cycles, to provide the appropriate anchoring footprint.

The pole support bracket 21 depicted in FIGS. 8 and 9 includes a gusset 24 to strengthen the interface between the lower base portion 12 of pole 11 and the underlying substrate to support the jib crane assembly 10. Further support is provided by ground plate 26 which contains a structure having a threaded opening 28. An adjustment screw 25 can be used for adjusting the elevation of the pole bracket 21 for truing the pole 11 to which the pole bracket is attached. The adjustment screw 25 also has an aperture 23 (seen in the embodiment illustrated in FIG. 10 and described below) for a wedge anchor bolt 200, which passes through the adjustment screw and through the ground plate. A wedge portion 201 of anchor bolt 200 interfaces with the foundational substrate, such as concrete, in a conventional manner. The wedge anchor bolt 200 is tightened down once the proper leveling adjustment has been made with adjustment screw 25.

Figure 10:
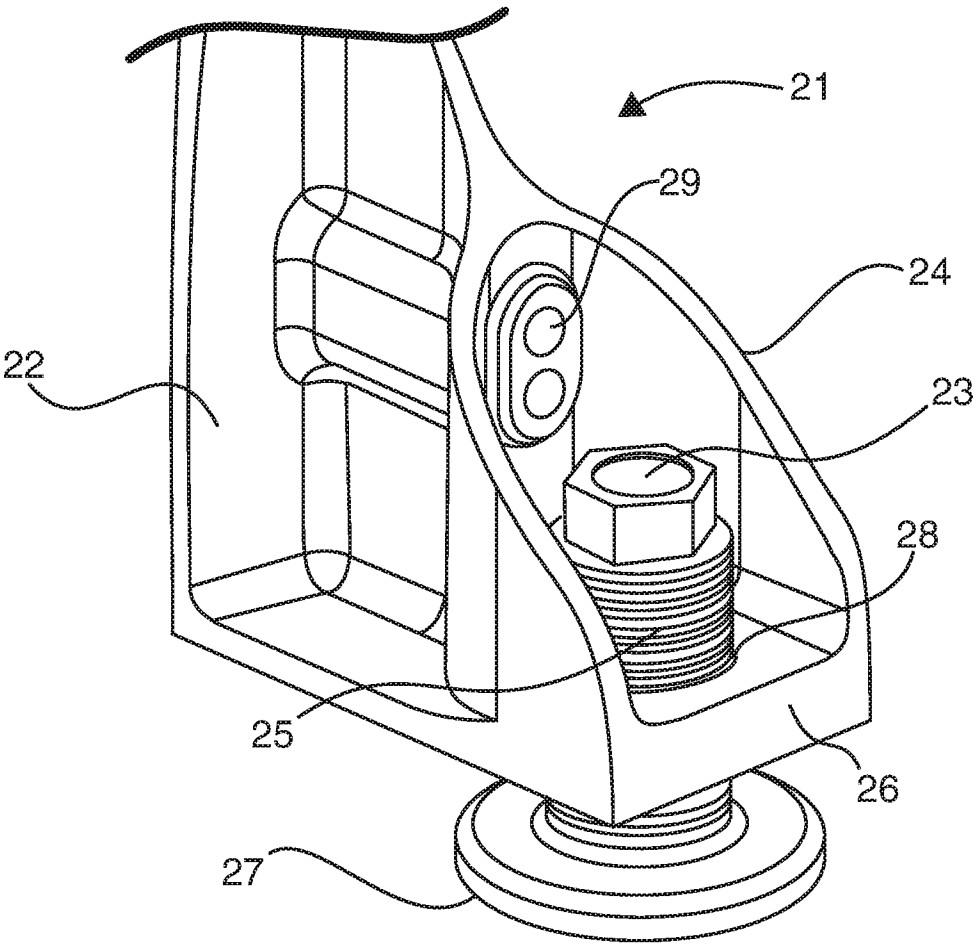
FIG. 10 is a partial detail view of yet another alternative support bracket configuration being adjustable for truing the pole.

A variation of the pole support bracket 21 shown in FIG. 8 is illustrated in FIG. 10. Here, a somewhat different arrangement between the pole engagement plate 22 and gusset 24 is used. Also, a footplate 27 is used to provide superior leveling and extend the load over a larger area of the foundational substrate. The use of footplate 27 means less of the ground plate 26 has to engage the substrate, in contrast to the arrangement illustrated in FIGS. 8 and 9.

It should be understood that the aforementioned embodiments for the substrate interface-support structural arrangements 20, 21 (illustrated in FIGS. 1, 8, and 10) are not necessarily required within the context of the inventive jib crane assembly 10. Rather, other substrate interface-support arrangements can be used. For example, the pole of the present invention can be mounted in a steel plate in the bed of the truck. Further yet, other arrangements, besides the depicted pole brackets, could be used under these circumstances. It should be noted that because of the compact arrangement of the present invention, vehicle mounting is particularly convenient. The compact arrangement also ensures ease of operation.

Accordingly, the present invention can be embodied by devices of a substantial number of different sizes and load types. The type of substrate interface-support arrangement can vary based upon the nature of the utility, space requirements, substrate and the loads to be handled. Further, the present invention need not be fixed. For example, the jib crane assembly 10 of the present invention can be mounted on a wheeled trolley, such as those used for hoisting automobile engines from a vehicle. All that matters is that sufficient width of the trolley be provided to accommodate the lifting duties of the selected jib crane assembly 10. The actual substrate interface-support arrangement or mounting system can be left up to the particular application in which the present invention is to be used.

While preferred embodiments, and multiple variations thereof, have been described by way of example, the present invention is not limited thereto. rather, the present invention should be interpreted to include any and all variations, adaptations, permutations, and derivations that would occur to one skilled in this art, and in possession of the teachings of the present invention. Accordingly, the present invention should be limited only by the following claims.

The invention claimed is:

1. An interconnecting boom support system having operatively tied and dynamically interactive compression support and tension support arrangements, comprising:

a) a cylindrical pole for vertical alignment having an outer surface and a length with an upper segment;

b) a pivot structure arranged at the upper segment of the pole;

c) a boom for lifting a load, the boom being rotatably secured to the pivot structure at a pivot point along a length of said boom thereby dividing said boom into first and second portions;

d) the compression support arrangement having an elongated compression support extending diagonally from an underside of the first portion of said boom to a pivoting connection of a compression roller engagement assembly positioned for rotatable engagement at the outer surface of said cylindrical pole, the elongated compression support being attached to the first portion of said boom at a bracket having pivotal adjustment;

e) the tension support arrangement including a tension roller engagement assembly secured to a vertical connector extending perpendicular from the second portion of said boom, whereby the vertical connector facilitates a counterbalance to a weight of the first portion of the boom, the tension roller engagement assembly being positioned and pivotally connected to the vertical connector for rotatable engagement around the outer surface of said cylindrical pole opposite the compression roller engagement assembly; and f) the tension support arrangement further having a tension frame with a pair of tension arms, each arm having pivotal adjustment and a length extending from the tension roller engagement assembly to the compression roller engagement assembly; and wherein said first portion of said boom, elongated compression support, compression roller engagement assembly, tension frame and tension roller arrangement assembly, vertical connector, and second portion of said boom are arranged, pivotally interconnected, and counterbalanced to provide operatively tied dynamically interactive structural support for lifting the load; and, wherein said pivot structure at the upper segment of the cylindrical pole, said compression roller engagement assembly, and said tension roller engagement assembly facilitate rotation of the load around said cylindrical pole, wherein the rollers in said tension roller engagement assembly and said compression roller engagement assembly are pivotally adjustable for lateral contact against said outer surface of said cylindrical pole for rotational mobility of the boom.

2. The interconnecting boom support system of claim 1, wherein the tension roller engagement assembly is configured for arrangement proximate the pivot structure at the upper segment of the cylindrical pole, and the compression roller engagement assembly is configured for arrangement in vertical spaced relationship below the tension roller engagement assembly.

3. The interconnecting boom support system of claim 2, wherein said tension arms are arranged on opposite sides of said cylindrical pole.

4. The interconnecting boom support system of claim 3, further comprising a tension arm connection bracket flank and secure to the vertical connector connecting a proximate end of said boom to said tension roller engagement assembly.

5. The interconnecting boom support system of claim 4, wherein each of said tension arms of said tension frame includes an end plate portion at a first end of the corresponding length for pivotal attachment at the tension roller engagement assembly and is connected to said compression support arrangement at a second end.

6. The interconnecting boom support system of claim 5, wherein each of said compression roller engagement assembly and said tension roller engagement assembly comprises at least three rollers affixed to a corresponding roller yoke, and the roller yoke in the tension roller engagement assembly being positioned on a side of the cylindrical pole opposing the yoke of the compression roller engagement assembly on an opposite side of the cylindrical pole.

7. The interconnecting boom support system of claim 6, wherein said boom comprises an I-beam.

8. The interconnecting boom support system of claim 7, wherein a lower segment of the pole includes a support section at an end opposite said pivot structure, the support structure comprises a support plate extending perpendicular to said cylindrical pole for engagement to a ground substrate, the support section having a plurality of support fins extending lateral from the outer surface of said cylindrical pole.

9. The interconnecting boom support system of claim 8, wherein said pivot structure is held in place to freely rotate the boom about the pole without the boom being rigidly affixed at the upper segment of the pole by the pivotal interconnection between the boom, compression support, compression roller engagement assembly, tension frame, and tension roller engagement assembly.

10. The interconnecting boom support system of claim 7, further comprising at least one substrate interface-support bracket, said at least one interface-support bracket having a vertical portion connecting directly to said cylindrical pole and a ground plate supporting a screw structure arranged to level said bracket when interfacing with said substrate.

* * * * *